US005569135A

United States Patent [19]

Chen

[11] Patent Number: 5,569,135

[45] Date of Patent: Oct. 29, 1996

[54] PULLING EXERCISER

[76] Inventor: Tseng-Cheng Chen, P.O. Box 82-144, Taipei, Taiwan

[21] Appl. No.: 575,390

[22] Filed: Dec. 20, 1995

[51] Int. Cl.[6] ..... A63B 21/02

[52] U.S. Cl. ..... 482/125; 482/124; 482/126

[58] Field of Search ..... 482/121, 122, 482/124, 125, 126

[56] References Cited

U.S. PATENT DOCUMENTS

| | | | |
|---|---|---|---|
| 1,980,861 | 11/1934 | Hunter | 482/125 |
| 4,195,835 | 4/1980 | Hinds et al. | 482/125 |
| 4,304,402 | 12/1981 | Ripp | 482/125 |
| 4,517,966 | 5/1985 | von Othegraven | 482/125 |
| 4,591,150 | 5/1986 | Mosher | 482/125 |
| 4,736,946 | 4/1988 | Gordon | 482/125 |
| 5,137,503 | 8/1992 | Yeh | 482/125 |
| 5,197,934 | 3/1993 | Wirtz | 482/125 |

FOREIGN PATENT DOCUMENTS

| | | | |
|---|---|---|---|
| 2234017 | 1/1975 | France | 482/125 |

*Primary Examiner*—Lynne A. Reichard
*Attorney, Agent, or Firm*—Alfred Lei

[57] ABSTRACT

A pulling exerciser including a foot bar having one end terminating in a head and an opposite end fastened with an end cap, two foot plates mounted around the foot bar, each foot plate having a plurality of raised portions for massaging the foot, a handlebar having a fixed handgrip at one end and a ribbed portion at an opposite end mounted with a tubular handgrip secured in place by an end cap, and a spring connected between the handlebar and the foot bar.

1 Claim, 3 Drawing Sheets

PULLING EXERCISER

BACKGROUND OF THE INVENTION

1. Field of the Invention

The present invention relates to an exercising apparatus, and relates more particularly to a pulling exerciser for pulling exercises.

2. Description of the Prior Art

Various handy exercising apparatuses have been developed for exercising the muscles of different parts of the body. Pulling exerciser is one the most popularly accepted personal exercising apparatus for exercising the hands and the legs. However, regular commercially available pulling exercisers are commonly expensive. Because they are assembled at factory, they require much delivery space.

SUMMARY OF THE INVENTION

This invention is directed to an exercising apparatus and in particular to a pulling exerciser.

It is one object of the present invention to provide a pulling exerciser which is a DIY (do-it-yourself) design that can be conveniently assembled by the consumer. It is another object of the present invention to provide a pulling exerciser which is inexpensive to manufacture.

A pulling exerciser according to the present invention comprises a foot bar having a head at one end, a plurality of outside longitudinal ribs raised from an outside wall thereof, a plurality of inside longitudinal ribs raised from an inside wall thereof, and a plurality of recessed portions spaced around the inside wall near one end remote from the head; a handlebar having a fixed handgrip at one end, a plurality of outside longitudinal ribs raised from an outside wall thereof, a plurality of inside longitudinal ribs raised from an inside wall thereof, and a plurality of recessed portions spaced around the inside wall near one end remote from the head; a tubular handgrip sleeved onto the outside longitudinal ribs of the handlebar; a spring having a first end connected to the foot bar and a second end connected to the handlebar; two foot plates respectively mounted around the foot bar, each foot plate having a plurality of raised portions for massaging the foot; a first end cap fastened to one end of the handlebar remote from the fixed handgrip to secure the tubular handgrip in place, the first end cap comprising a plurality of longitudinal grooves engaged with the inside longitudinal ribs of the handlebar, a plurality of hinged split strips spaced between the longitudinal grooves of the first end cap, and a plurality of raised portions respectively raised from each split strip of the first end cap and engaged with the recessed portions of the handlebar; a second end cap fastened to one end of the foot bar remote from its head to secure the foot plates in place, the second end cap comprising a plurality of longitudinal grooves engaged with the inside longitudinal ribs of the foot bar, a plurality of hinged split strips spaced between the longitudinal grooves of the second end cap, and a plurality of raised portions respectively raised from each split strip of the second end cap and engaged with the recessed portions of the foot bar; a first pair of friction rings respectively mounted around the handlebar and stopped at two opposite sides by the second end of the spring between the tubular handgrip and the fixed handgrip; and a second pair of friction rings respectively mounted around the foot bar and stopped at two opposite sides by the first end of the spring between the foot plates.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
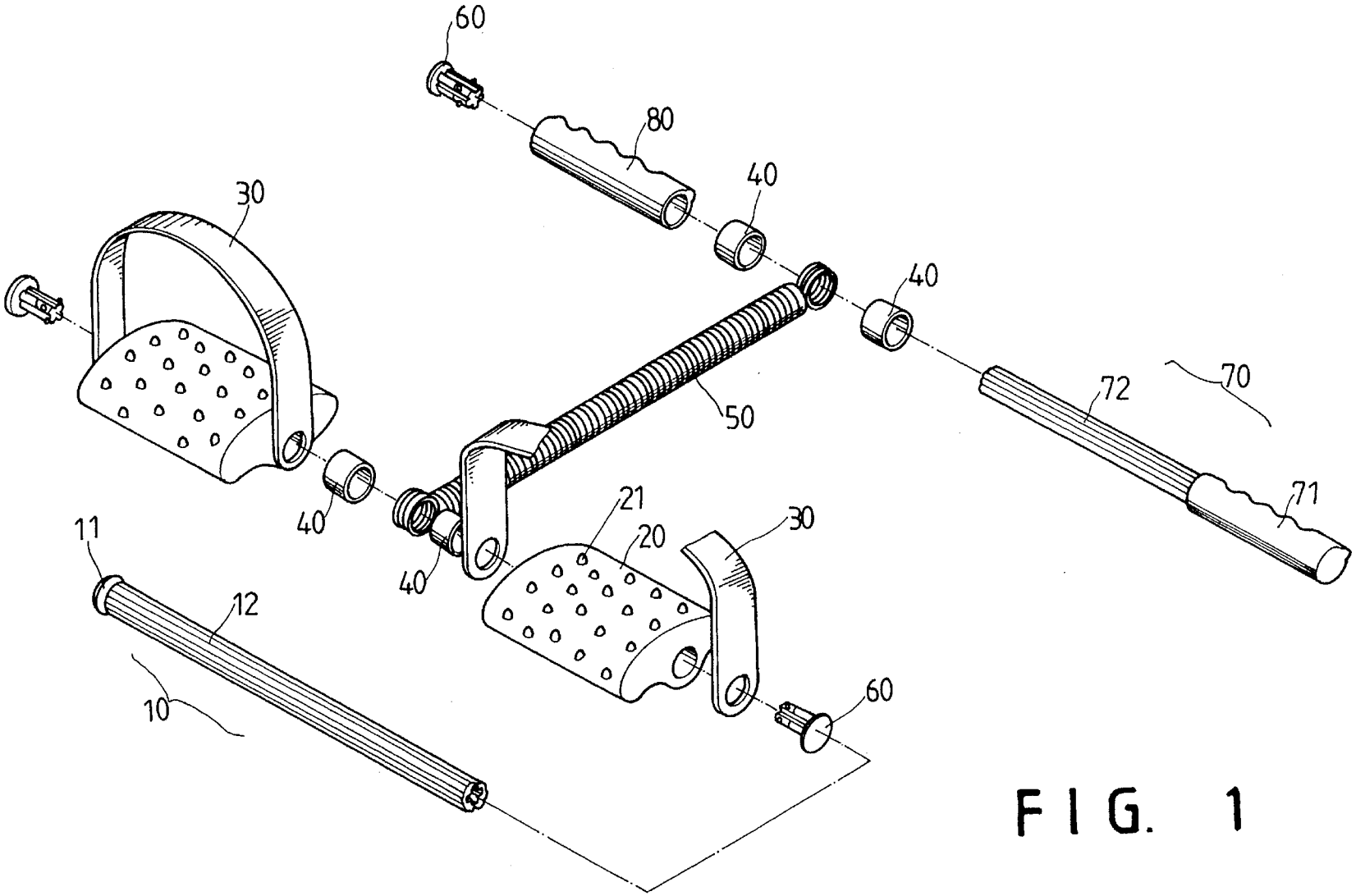
FIG. 1 is an exploded view of a pulling exerciser according to the present invention.

For purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Referring to FIG. 1, a pulling exerciser in accordance with the present invention is generally comprised of a foot bar 10, which holds two foot plates 20, a handlebar 70, and a spring 50 connected between the foot bar 10 and the handlebar 70.

Figure 2:
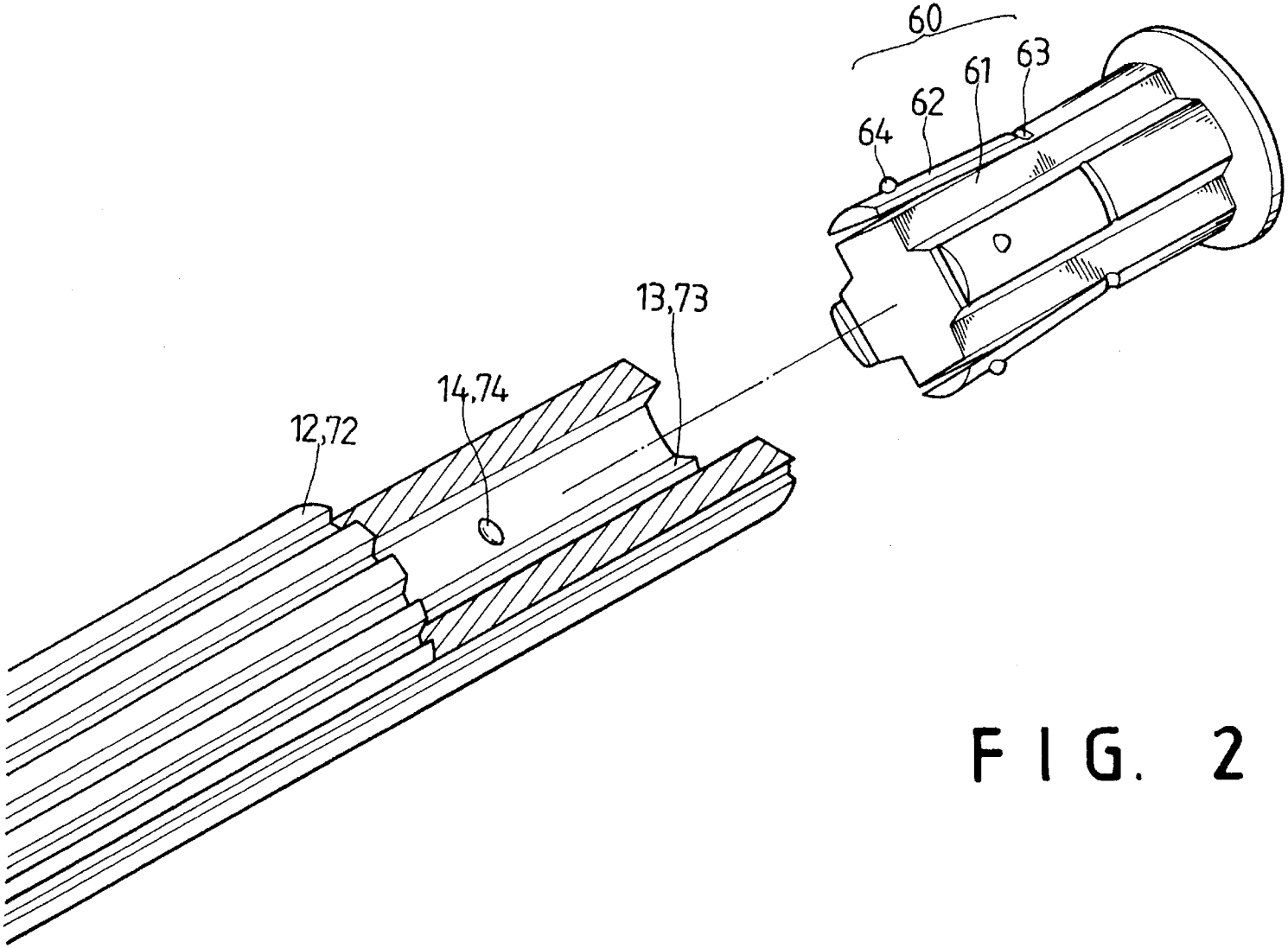
FIG. 2 shows the detailed structure of the end cap and the handlebar (foot bar) according to the present invention.
Figure 3:
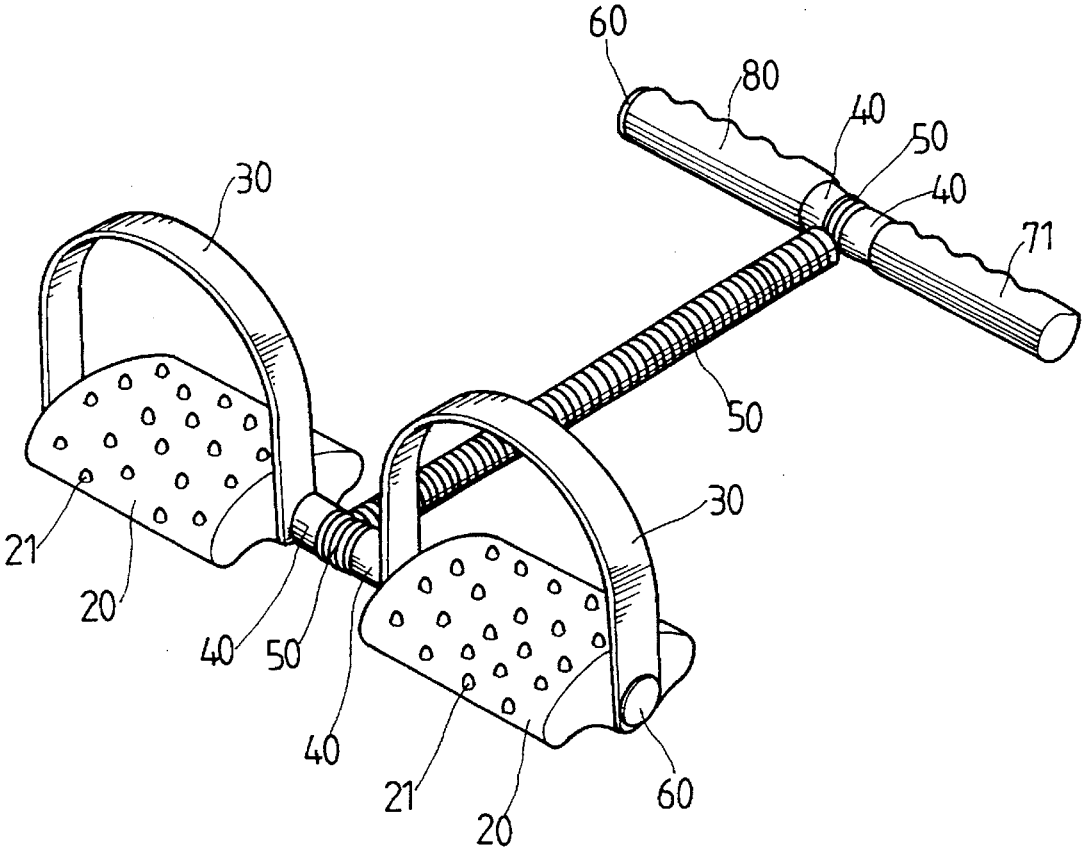
FIG. 3 is an elevational view of the pulling exerciser shown in FIG. 1.

Referring to FIGS. 2 and 3, and FIG. 1 again, the foot bar 10 comprises a head 11 at one end, a plurality of outside longitudinal ribs 12 raised from the outside wall, a plurality of inside longitudinal ribs 13 raised from the inside wall, and a plurality of recessed portions 14 spaced around the inside wall near one end remote from the head 11. When the foot plates 20 and the spring 50 are respectively mounted on the foot bar 10, the opposite end (remote from the head 11) is fastened with an end cap 60. The handlebar 70 comprises a handgrip 71 fixedly secured at one end, a plurality of outside longitudinal ribs 72 raised from the outside wall, a plurality of inside longitudinal ribs 73 raised from the inside wall, and a plurality of recessed portions 74 spaced around the inside wall near one end remote from the head 71. When assembled, a tubular handgrip 80 is sleeved onto the outside longitudinal ribs 72 of the handlebar 70, and an end cap 60 is fastened to the handlebar 70 remote from the fixed handgrip 71 to secure the tubular handgrip 80 in place. Two foot guards 30 are respectively mounted on the foot bar 10 and attached to each foot plate 20. Two pairs of friction rings 40 are respectively mounted around the foot bar 10 and the handlebar 70, and bilaterally attached to each end of the spring 50. Furthermore, each of the foot plates 20 has a plurality of raised portions 21 for massaging the foot.

Referring to FIG. 2 again, each of the end caps 60 comprises a plurality of longitudinal grooves 61 for engagement with the inside longitudinal ribs 13 of the foot bar 10 or the inside longitudinal ribs 73 of the handlebar 70, a plurality of split strips 62 secured in plate by a respective hinge portion 63, and a plurality of raised portions 64 respectively raised from each split strip 62 for engagement with the recessed portions 14 of the foot bar 10 or the recessed portions 74 of the handlebar 70.

While only one embodiment of the present invention has been shown and described, it will be understood that various modifications and changes could be made without departing from the spirit and scope of the invention disclosed.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A pulling exerciser comprising:

a foot bar having a head at one end, a plurality of outside longitudinal ribs raised from an outside wall thereof, a plurality of inside longitudinal ribs raised from an inside wall thereof, and a plurality of recessed portions spaced around the inside wall near one end remote from said head;

a handlebar having a fixed handgrip at one end, a plurality of outside longitudinal ribs raised from an outside wall thereof, a plurality of inside longitudinal ribs raised from an inside wall thereof, and a plurality of recessed portions spaced around the inside wall near one end remote from said head;

a tubular handgrip sleeved onto the outside longitudinal ribs of said handlebar;

a spring having a first end connected to said foot bar and a second end connected to said handlebar;

two foot plates respectively mounted around said foot bar, each foot plate having a plurality of raised portions for massaging the foot;

a first end cap fastened to one end of said handlebar remote from said fixed handgrip to secure said tubular handgrip in place, said first end cap comprising a plurality of longitudinal grooves engaged with the inside longitudinal ribs of said handlebar, a plurality of hinged split strips spaced between the longitudinal grooves of said first end cap, and a plurality of raised portions respectively raised from each split strip of said first end cap and engaged with the recessed portions of said handlebar;

a second end cap fastened to one end of said foot bar remote from its head to secure said foot plates in place, said second end cap comprising a plurality of longitudinal grooves engaged with the inside longitudinal ribs of said foot bar, a plurality of hinged split strips spaced between the longitudinal grooves of said second end cap, and a plurality of raised prtions respectively raised from each split strip of said second end cap and engaged with the recessed portions of said foot bar;

a first pair of friction rings respectively mounted around said handlebar and stopped at two opposite sides by the second end of said spring between said tubular handgrip and said fixed handgrip; and a second pair of friction rings respectively mounted around said foot bar and stopped at two opposite sides by the first end of said spring between said foot plates.

* * * * *